US007509822B2

(12) United States Patent
Ishida et al.

(10) Patent No.: US 7,509,822 B2
(45) Date of Patent: Mar. 31, 2009

(54) ARTICLE OF CLOTHING WITH EFFECTS OF BACK PAIN EXERCISE

(75) Inventors: Nobuo Ishida, Kobe (JP); Shinji Hada, Kobe (JP)

(73) Assignee: NLC Co., Ltd., Kobe-shi (JP)

( * ) Notice: Subject to any disclaimer, the term of this patent is extended or adjusted under 35 U.S.C. 154(b) by 0 days.

(21) Appl. No.: 12/027,374

(22) Filed: Feb. 7, 2008

(65) Prior Publication Data

US 2008/0201830 A1 Aug. 28, 2008

(30) Foreign Application Priority Data

Feb. 27, 2007 (JP) ..... 2007-047242

(51) Int. Cl.
*A41B 9/00* (2006.01)

(52) U.S. Cl. ..... 66/177; 2/401

(58) Field of Classification Search ..... 66/177, 66/175, 176; 2/401, 227, 228, 240, 239; 450/97, 98

See application file for complete search history.

(56) References Cited

U.S. PATENT DOCUMENTS 4,325,379 A * 4/1982 Ozbey ..... 450/116
5,201,074 A * 4/1993 Dicker ..... 2/70
5,590,548 A * 1/1997 Osborne ..... 66/177
5,778,452 A * 7/1998 Dicker et al. ..... 2/69
5,787,732 A * 8/1998 Perron et al. ..... 66/177
5,888,118 A * 3/1999 Kishi ..... 450/122
5,996,120 A * 12/1999 Balit ..... 2/67
6,080,038 A * 6/2000 Sano ..... 450/155
6,119,491 A * 9/2000 Pinelli ..... 66/177
D452,763 S * 1/2002 Kataoka ..... D2/704
6,401,497 B1 * 6/2002 Nishiyama et al. ..... 66/172 E
6,430,753 B2 * 8/2002 Duran ..... 2/239
6,874,337 B2 * 4/2005 Uno et al. ..... 66/177
7,043,942 B2 * 5/2006 Chapman ..... 66/177
7,087,032 B1 * 8/2006 Ikeda ..... 602/19
7,143,453 B2 * 12/2006 Duran ..... 2/409
7,260,961 B1 * 8/2007 Kennedy ..... 66/177

FOREIGN PATENT DOCUMENTS

JP 10-130910 A 5/1998

(Continued)

*Primary Examiner*—Danny Worrell
(74) *Attorney, Agent, or Firm*—Westerman, Hattori, Daniels & Adrian, LLP.

(57) ABSTRACT

An article of clothing has a main body formed of high-tightness, main-body knitting fabric made of power net. The article of clothing includes front and back support pieces disposed around the waist and having no elasticity in a longitudinal direction thereof. The front support pieces are sewn to a front body at positions inside the left and right ilia of the abdominal pelvis. The back support pieces are sewn to a back body at left and right positions near the sacrum of the pelvis in central hip portions. Side waist pieces disposed between the front and back support pieces are formed by sewing high-tightness, net-like knitting fabric to the main-body knitting fabric at the top edge while leaving the bottom edge unsewn. The article of clothing has a pant-like shape with left and right leg parts that can be tightly fitted around the thighs.

4 Claims, 5 Drawing Sheets

FOREIGN PATENT DOCUMENTS

| | | | |
|---|---|---|---|
| JP | 11-256403 | A | 9/1999 |
| JP | 2001-192903 | A | 7/2001 |
| JP | 2002-345866 | A | 12/2002 |
| JP | 3102742 | U | 7/2004 |
| JP | 2006-89856 | A | 4/2006 |
| JP | 4024287 | B1 | 12/2007 |
| JP | 7-6213 | U | 2/2008 |

* cited by examiner

ARTICLE OF CLOTHING WITH EFFECTS OF BACK PAIN EXERCISE

BACKGROUND OF THE INVENTION

1. Field of the Invention

The present invention relates to an article of clothing with effects of back pain exercise, which can be worn as underwear or outerwear for preventing or relieving back pain and which has functions of posture improvement and body shape correction.

2. Description of the Related Art

Many people suffer from back pain due to various causes. Back pain is generally treated with conservative management and lifestyle education for maintaining and increasing physical strength. However, the biggest problem with back pain is that it often recurs. Back pain may lead to various diseases, the most common of which is lumbago. Although lumbago patients show no abnormality in the results of X-ray examinations and other tests, they suffer from pain caused by load concentration and accumulation of fatigue at the lumbar region due to insufficient muscle strength, posture problems, etc. Lumbago is generally treated with exercise therapy. Although the pain can be relieved by bed rest, it is difficult for the patients to take bed rest in modern living and in the economic environment. Therefore, the patients often exacerbate their symptoms.

The weight of the upper half of the body is supported by the lumbar spine that is positioned substantially at the center of the body. The lumber spine supports the weight of the upper half of the body and also receives a ground reaction force at the same time. Therefore, stress concentration occurs at the lumbar spine. As body weight increases, load on the lumbar spine, of course, also increases. The lumbar spine inherently has physiological lordosis. However, if the lordosis is increased, the pelvis tilts forward and force applied to intervertebral disks serves as a shear force. As a result, a stress is applied to paravertebral muscles and ligaments, which often leads to back pain. Displacement of sacroiliac joints is also considered to be the cause of back pain. The pelvis is constituted of two ilia and a sacrum with the sacroiliac joints disposed therebetween. Different from diarthroses, the sacroiliac joints are called plane joints or synarthrodial joints and are disposed at the center of movement. If the pelvis including the sacroiliac joints is tilted, it becomes difficult to stand upright. Accordingly, the abdominal muscle group mainly serves to reduce the lordosis of the lumber spine by tilting the pelvis rearward. If the abdominal muscles are strong, a high abdominal pressure is generated and force applied to the lumbar spine and the paravertebral muscles can be distributed.

Back braces, such as back supporters and back bands, have been described in reports regarding corsets. Back braces are generally prescribed in orthopedic clinics, but are also used outside medical facilities by many athletes irrespective of whether or not they have a lumbar disease. The purposes of using them are: (1) to limit vertebral segment motion; (2) to reduce load on the spine by increasing intra-abdominal pressure; (3) to suppress trunk muscle activity; (4) to reduce trunk muscle fatigue; and (5) to obtain a heat insulation effect. In research studies carried out in 1997, the effects of back braces in the acute phase of lumbago were studied by surface electromyogram. As a result, it was found that back braces have an effect of reducing dorsi muscle activity and fatigue. However, it has also been found that long-term use of back braces may cause disuse of dorsi muscles and reduction in lumbar spine mobility, which may lead to chronic lumbago. Therefore, it is important to begin exercise therapy after the pain is relieved by using a back brace for a certain period. The above-mentioned purposes corresponding to the advantages of corsets can be reliably achieved by the corsets. In particular, it is commonly known that it is important to reduce load on the spine by increasing intra-abdominal pressure for preventing and relieving back pain.

To enhance the above-described advantages, Williams has proposed Williams exercises, which is the most common method of exercise therapy for back pain. Regular practice of Williams exercises leads to posture correction, recovery of joint function, increase in muscle strength, and improvements in muscular coordination and tolerance so that motion velocity can be increased. In other words, supporting characteristics and mobility of the muscles, ligaments, and intervertebral joint capsules around the lumbosacral spine are normalized and posture is corrected for curing back pain. Various kinds of back pain exercises have been suggested. One common principle of the various back pain exercises is to extend muscles, ligaments, joint capsules including synovium and fibrous membrane, etc., in the lumbar portion of the back and the legs and to increase the muscle strength of the trunk muscles. In particular, importance is generally placed on strengthening abdominal muscles for reducing lumbar lordosis and increasing abdominal pressure.

Japanese Unexamined Patent Application Publication No. 2006-89856 describes leggings having highly elastic parts in predetermined areas in the back, the predetermined areas corresponding to areas where the skin is highly stretched at the buttocks and back thighs when the thighs are raised. The highly elastic parts have a higher modulus of elasticity in the height direction than those of parts in areas other than the predetermined areas in the back and in areas corresponding to at least an abdomen and front thighs in the front.

Japanese Unexamined Patent Application Publication No. 2001-192903 describes a girdle made of elastic knitting fabric and capable of improving the stability of hip joints, creating a youthful body shape and posture, relieving back pain, and aiding in the prevention of falling for old people.

In addition, Japanese Unexamined Patent Application Publication No. 2002-345866 describes a waist belt for relieving back pain.

Very few people are patient enough to continue Williams exercises for back pain, and it is difficult to manage time and have a suitable environment for restarting the exercises. Accordingly, there has been a demand for an article of clothing capable of assisting and extending muscles in the lumbar portion of the back and back thighs and strengthening the muscles in the abdomen and front thighs during daily life on the basis of the principle of back pain exercise. To comply with such a demand, an article of clothing capable of assisting the muscles and skeleton construction has been developed. Accordingly, development of an article of clothing that provides effects of back pain exercise based on the principle of Williams exercises or the like in a daily life environment is demanded.

SUMMARY OF THE INVENTION

Accordingly, an object of the present invention is to provide an article of clothing that provides effects of back pain exercise for relieving or curing back pain when worn by a user and that has functions of posture improvement and body shape correction.

To achieve the object, according to an aspect of the present invention, an article of clothing for a lower half of a body has a function of body shape correction and includes a main body formed of main-body knitting fabric that provides a high degree of tightness and that is made of power net. The article of clothing includes front support pieces formed of interlining having no elasticity in a longitudinal direction thereof, the front support pieces being sewn to a front body of the article of clothing at left and right positions inside the ilia on the left and right of the abdominal pelvis of the wearer; and back support pieces formed of interlining having no elasticity in a longitudinal direction thereof, the back support pieces being sewn to a back body of the article of clothing at left and right positions that are closer to the back support piece than the gluteus medius muscles of a wearer. Waist pieces extend rearward from side portions between the front support pieces and the respective back support pieces to regions around the gluteus medius muscles. The waist pieces have a three-layer structure including the main-body knitting fabric and net-like knitting fabric folded at a bottom edge to form a two-layer structure and placed on the main-body knitting fabric, the net-like knitting fabric providing a high degree of tightness. A navel cover piece provided in the front body has a three-layer structure in which the main-body knitting fabric is folded so as to sandwich the net-like knitting fabric. An abdomen piece disposed below the navel cover piece has a two layer structure including the main-body knitting fabric facing outside and the net-like knitting fabric facing inside. The waist pieces having the three-layer structure and the navel cover piece having the three-layer structure are configured to increase an abdominal pressure, which is said to be effective in preventing or relieving back pain. Both sides of the pelvis are pulled rearward by the net-like knitting fabric of the waist portions so that the position of the pelvis is corrected. Accordingly, a forward movement of the sacrum is facilitated and physiological lordosis of the lumbar spine is reduced. To achieve this, in the waist pieces having the three-layer structure, the main-body knitting fabric and the net-like knitting fabric folded to form the two-layer structure are sewn together at a top edge thereof. In addition, the folded bottom edge of the net-like knitting fabric forming the two-layer structure is not sewn to the main-body knitting fabric and is free from the main-body knitting fabric in areas other than a central area of the back body. The article of clothing has a high-waist structure to provide a function of posture improvement when the article of clothing is worn. In addition, the article of clothing has a pant-like shape with left and right leg parts that can be tightly fitted around the thighs.

Preferably, in the article of clothing according to the aspect of the present invention, a piece disposed below the waist in the back body so as to cover a region including the gluteus medius muscles, the sacrum, and the lumber spine is formed only of the main-body knitting fabric. In addition, a waist piece disposed between the left and right back support pieces in a central area of the back body is formed only of the net-like knitting fabric folded, thereby providing a tight-fit feeling. In addition, the waist pieces between the front support pieces in the front body and the respective back support pieces are tightly restrained such that the knitting fabric of the waist pieces is pulled toward the back support pieces.

In addition, preferably, in the article of clothing according to the aspect of the present invention, back thigh pieces of the article of clothing having the pant-like shape have a two-layer structure including the main-body knitting fabric and the net-like knitting fabric, so that tensile load is applied thereto when the thighs are lifted during walking. Thus, the article of clothing is expected to assist and extend muscles in the lumbar portion of the back and back thighs and strengthening the muscles in the abdomen and front thighs during daily life on the basis of the principle of back pain exercise.

In addition, preferably, in the article of clothing according to the aspect of the present invention, the main-body knitting fabric and the net-like knitting fabric have a tensile strength of 490 mN or more when stretched by 30% according to an elasticity test defined by Japanese Industrial Standard (JIS).

According to the present invention, the article of clothing for a lower half of a body with effects of back pain exercise has a function of body shape correction. The article of clothing improves the posture of the wearer and corrects distortion of the wearer's body without causing the wearer to bend forward. The left and right portions of the wearer's body are evenly pulled so as to reduce load of the weight placed on the spine, in particular the lumbar spine, and the abdominal pressure is increased so that the load applied to the lumbar region is reduced. In addition, the muscle activities during walking are changed such that the muscle activities in the front of the body are increased and the muscle activities in the back of the body are reduced. The overall change in the muscle activities serves to prevent or relieve back pain. Thus, the present invention provides particularly significant advantages that cannot be obtained by the structures of the related art.

DESCRIPTION OF THE PREFERRED EMBODIMENT

Figure 1:
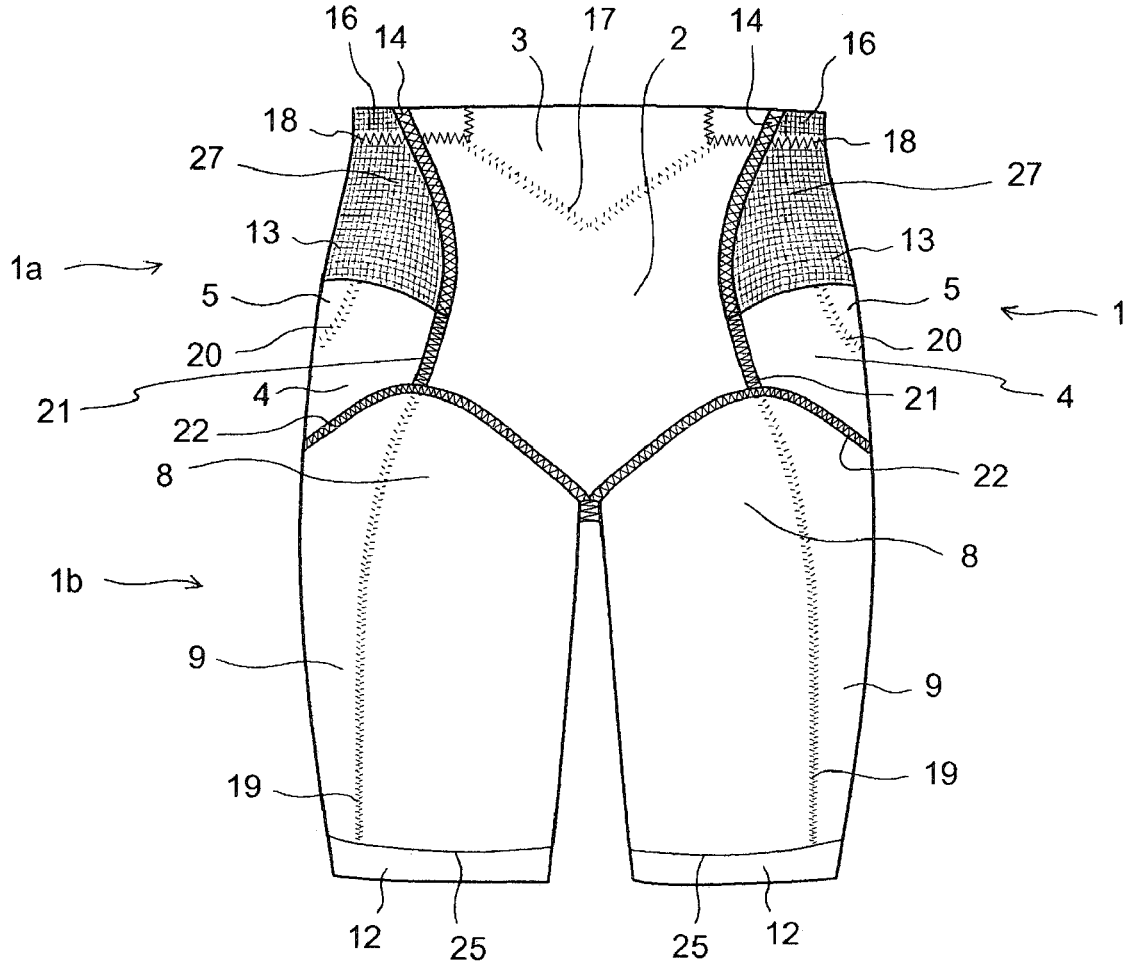
FIG. 1 is a front view of an article of clothing with effects of back pain exercise according to the present invention.

An embodiment of the present invention will be described below. Referring to FIGS. 1 to 4, an article of clothing 1 with effects of back pain exercise according to the embodiment is made of knitting fabric and has a function of body shape correction when worn by a user. The article of clothing 1 includes a torso part 1*a* and left and right leg parts 1*b* disposed below the torso part 1*a*. The torso part 1*a* includes an abdomen piece 2 and left and right hip pieces 6. Each leg part 1*b* includes a central thigh piece 8, an outer thigh piece 9, and a back thigh piece 10. A main body of the article of clothing 1 is formed of main-body knitting fabric 26 that is made of power net to provide a high degree of tightness. Waist pieces provided between front support pieces 14 and respective back support pieces 15 and the back thigh pieces 10 of the leg parts 1*b* are formed by placing net-like knitting fabric 27 that provides a high degree of tightness on the main-body knitting fabric 26. A piece disposed between the left and right back support pieces 15 is formed only of the net-like knitting fabric 27. The main-body knitting fabric 26 made of power net and the net-like knitting fabric 27 both provide a high degree of tightness and have a tensile strength of 490 mN or more when they are stretched by 30%. However, the tensile strength of each of the main-body knitting fabric 26 and the net-like knitting fabric 27 varies in accordance with the knitting structure, such as plain knit, rib knit, purl knit, double knit, tricot knit, atlas knit, cord knit, half-tricot knit, power net, marquisette, raschel, satin, leaver, Jacquard, dobby, circular knit, etc., and may be suitably selected as necessary.

Figure 3:
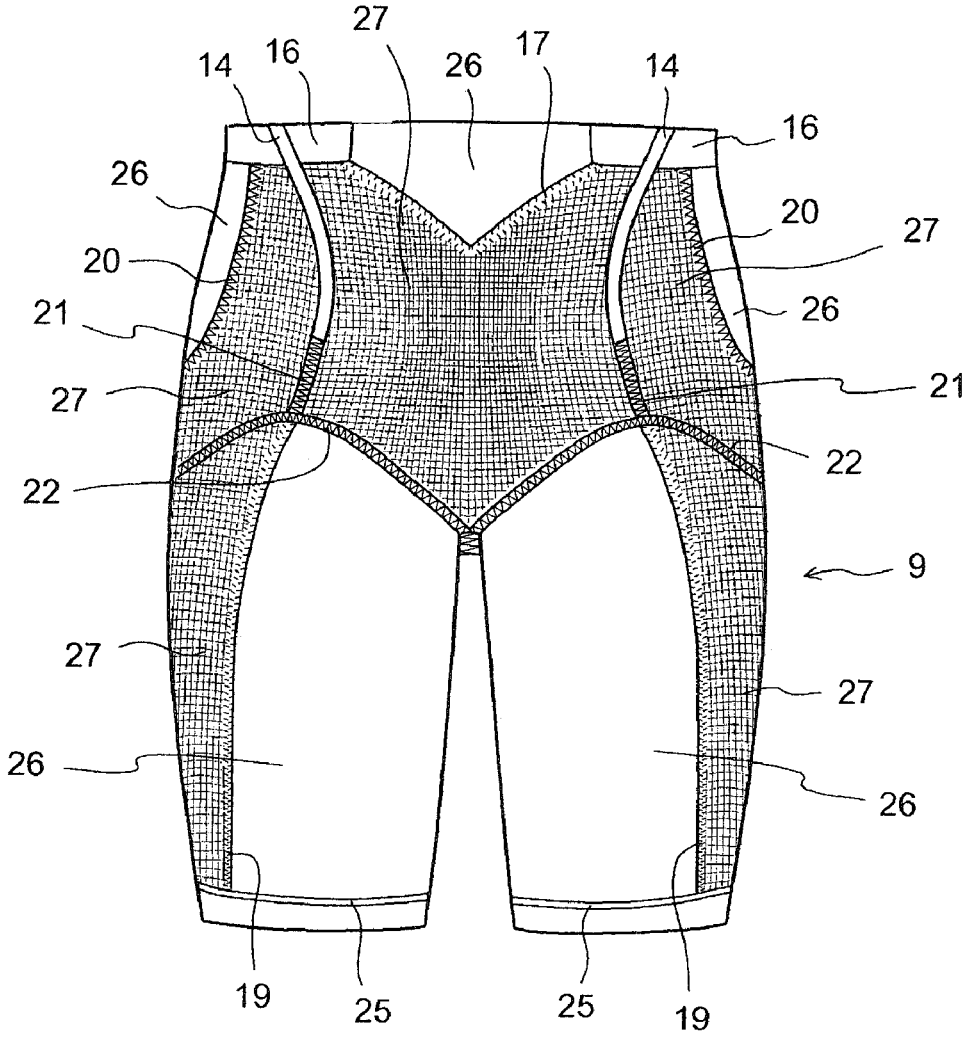
FIG. 3 is a front view of the inner side of the article of clothing with effects of back pain exercise according to the present invention in a reversed state.

Thus, the article of clothing 1 according to the present invention is formed of two kinds of knitting fabric: the main-body knitting fabric 26 and the net-like knitting fabric 27. The main-body knitting fabric 26 is made of mesh power net woven by polyurethane elastic yarn and having a high tightness rate such that an expansion ratio in the weft direction is higher than that in the warp direction. The main-body knitting fabric 26 has a tensile strength of 490 mN or more when stretched by 30%. The net-like knitting fabric 27 is woven by polyurethane elastic yarn and has approximately the same expansion ratio in the weft direction and the warp direction. Referring to FIG. 1, the torso part la of the front body of the article of clothing 1 has a navel cover piece 3 that is shaped such that the width thereof in the left-right direction is reduced toward the center of the abdomen piece 2. The navel cover piece 3 is positioned above a seam 17 and has a three-layer structure including an outer layer formed of the main-body knitting fabric 26, an inner layer facing the wearer's body skin and formed of the main-body knitting fabric 26, and a layer disposed between the inner and outer layers and formed of the net-like knitting fabric 27. The abdomen piece 2 positioned below the seam 17 of the navel cover piece 3 has a two-layer structure including an outer layer formed of the main-body knitting fabric 26 and an inner layer formed of the net-like knitting fabric 27, as shown in FIG. 3.

Side abdomen pieces 4 have a two-layer structure including an outer layer formed of the main-body knitting fabric 26 and an inner layer formed of the net-like knitting fabric 27. The outer layers of the side abdomen pieces 4 of the front body are formed integrally with each other such that, for example, the outer layer of the left side abdomen piece 4 formed of the main-body knitting fabric 26 extends through a left flank portion 5, the left hip piece 6 of the back body, the right hip piece 6, and a right flank portion 5, and continues to the right side abdomen piece 4 of the front body. The side abdomen pieces 4 have the two-layer structure including the main-body knitting fabric 26 and the net-like knitting fabric 27, and lower portions of the left and right side abdomen pieces 4 are respectively formed integrally with left and right lower hip pieces 7, respectively, of the back body.

Figure 2:
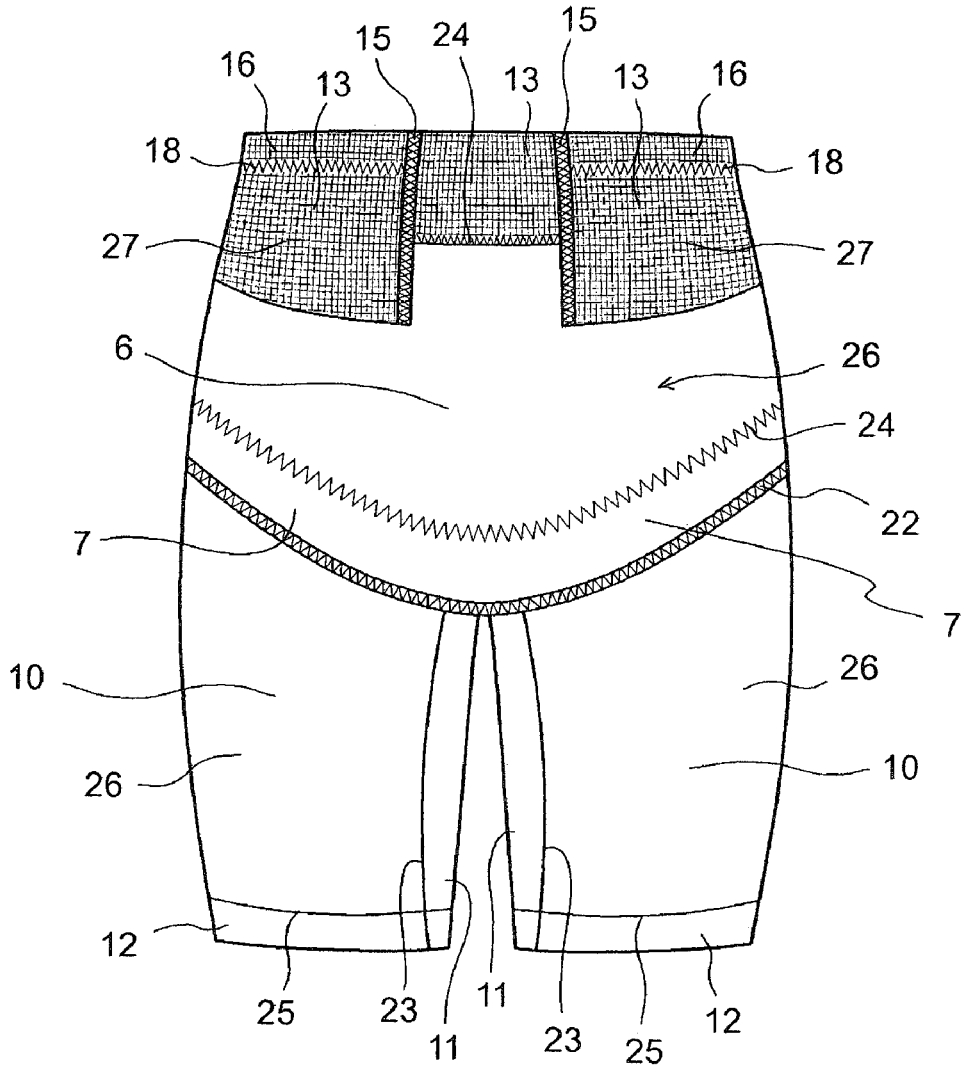
FIG. 2 is a rear view of the article of clothing with effects of back pain exercise according to the present invention.
Figure 4:
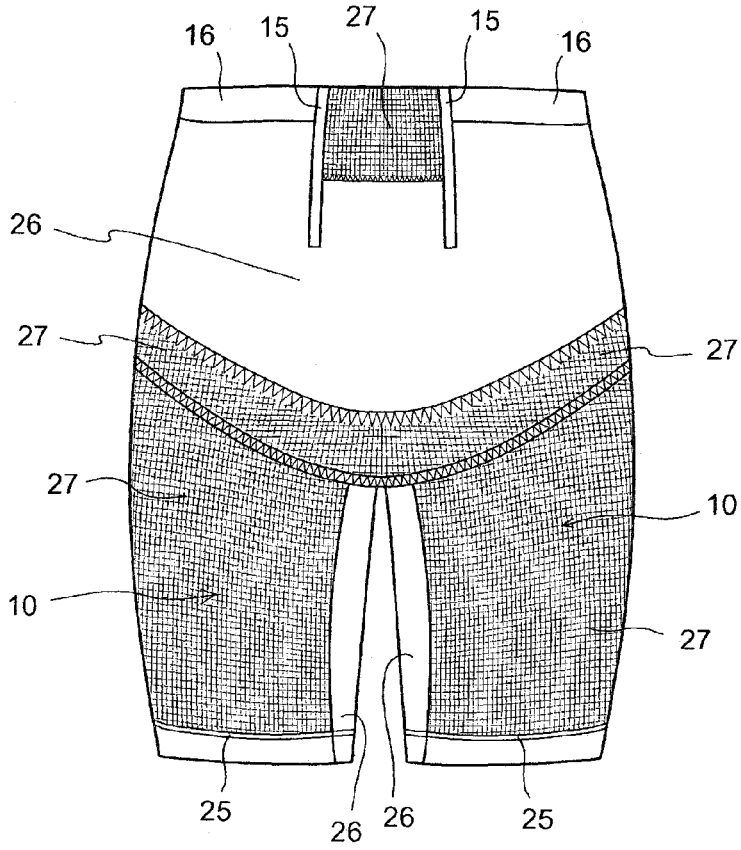
FIG. 4 is a rear view of the inner side of the article of clothing with effects of back pain exercise according to the present invention in a reversed state.

The left and right leg parts 1*b* that extend downward from the torso part 1*a* of the article of clothing 1 through joint seams 22 will now be described. The left and right central thigh pieces 8 that extend downward from the abdomen piece 2 having the two-layer structure through the joint seams 22 have a single-layer structure of the main-body knitting fabric 26. The left and right outer thigh pieces 9 respectively extend downward through the joint seams 22 from the left and right side abdomen pieces 4 having the outer layers formed of the main-body knitting fabric 26 and the inner layers formed of the net-like knitting fabric 27 and extending from the left and right hip pieces 6 through seams 20 shown in FIG. 3. The left and right outer thigh pieces 9 have a two-layer structure including outer and inner layers. The outer layers of the left and right outer thigh pieces 9 are formed of the main-body knitting fabric 26 and extend integrally from the left and right central thigh pieces 8, respectively, through seams 19. The inner layers of the left and right outer thigh pieces 9 are formed of the net-like knitting fabric 27 as shown in FIG. 3, and extend to the left and right back thigh pieces 10, respectively, of the back body, as shown in FIG. 4. The left and right back thigh pieces 10 have a two-layer structure including outer and inner layers. As shown in FIG. 2, the left and right central thigh pieces 8 having the single-layer structure of the main-body knitting fabric 26 extend along the inner sides of the thighs and are respectively sewn to the left and right back thigh pieces 10 having the two-layer structure with joint seams 23, thereby forming inner thigh portions 11. Bottom cuffs 12 are sewn to the thigh pieces and the back thigh pieces 10 with joint seams 25 at the bottom edge thereof. The bottom cuffs 12 are formed of the main-body knitting fabric 26, and are folded at the bottom edge thereof.

Left and right waist pieces 13 of the front body and a waist piece 13 of the back body that continues therefrom have a two-layer structure of the net-like knitting fabric 27 that is folded at the bottom edge and is sewn to a piece of elastic 16 with seams 18 at the top edge. The folded portions at the bottom of the waist pieces 13 are sewn to the main-body knitting fabric 26 disposed under the waist pieces 13 with a seam 24 only in the central area of the back body, and are free from the main-body knitting fabric 26 in other areas. The front support pieces 14 are thin plate shaped and are formed of interlining or rigid resin so as to extend along an upper half of joint seams 21 at the boundaries between the arch-shaped sides of the abdomen piece 2 and the side abdomen pieces 4 of the front body. The back support pieces 15 are thin plate shaped and are formed of interlining or rigid resin so as to extend in upper half portions of the hip pieces 6 of the back body. The front support pieces 14 become engaged with the left and right edges of the pelvis of the wearer when the article of clothing 1 with effects of back pain exercise is worn. Accordingly, the front support pieces 14 have a function of preventing the boundaries between the arch-shaped sides of the abdomen piece 2 and the side abdomen pieces 4 from being moved leftward or rightward when the knitting fabric of the article of clothing 1 is pulled at the left or right flank. The back support pieces 15 do not have elasticity in the longitudinal direction thereof, and are sewn to the back body at positions inside the muscles of back proper in inner areas of the hip pieces 6, that is, at left and right positions near the sacrum in the pelvis when the article of clothing 1 with effects of back pain exercise is worn. Accordingly, the back support pieces 15 have a function of preventing the back body from being moved leftward or rightward even when it is pulled leftward or rightward. Due to the above-described functions and the non-elastic bones, the stabilizer muscle groups around the lumbar spine in the wearer's body can be stably supported. In addition, the high-waist structure allows more adequate maintenance of the wearer's body shape and posture improvement when the article of clothing 1 is worn. Accordingly, effects of back pain exercise can be obtained.

As described above, when the article of clothing according to the present embodiment is worn, load is placed on the wearer's body so as to change the muscle activities of the wearer as the wearer walks. Thus, the muscle activities of rectus abdominis muscles and flexor muscle groups in the lower half of the body are enhanced. As a result, effects of back pain exercise for maintaining and improving the muscle strength of the stabilizer muscle groups around the lumbar spine can be obtained. Therefore, back pain can be prevented or relieved.

To confirm the above-described effects, articles of clothing having the structure of the article of clothing 1 according to the present invention with waist sizes 64 cm, 70 cm, and 79 cm were prepared. A verification test of the articles of clothing with effects of back pain exercise was performed as follows. That is, fifteen test subjects were asked to walk with and without wearing the articles of clothing, and muscle activities during walking were determined. The verification test of the articles of clothing with effects of back pain exercise was performed by a national university to ensure objectivity. Table 1 shows the physiques of the subjects. In the verification test, the muscle activities were determined by surface electromyogram, and electromyograms were taken at positions around the subject's torsos determined by palpation. More specifically, the electromyograms were taken at eight positions corresponding to iliocostal muscles, rectus abdominis muscles, gluteus medius muscles, gluteus maximus muscles, vastus lateralis muscles, rectus femoris muscles, biceps femoris muscles, and gastrocnemius muscles. The subjects walked along a 10-m path five times for one set, and repeated seven sets with and without wearing the articles of clothing with effects of back pain exercise according to the present invention. In the test, the subjects were asked to walk as usual without setting particular walking pace or step.

TABLE 1

Physiques of subjects.
15 Ordinary, healthy women; Average Age 33.8 ± 7.2 (21 to 42)

| Physiques | | | | | |
|---|---|---|---|---|---|
| Height (cm) | Weight (kg) | Waist Circ. (Abdominal) (cm) | Waist Circ. (Min.) (cm) | Hip Circ. (cm) | Thigh Circ. (cm) |
| 159.3 (7.7) | 56.8 (5.6) | 77.5 (7.5) | 71.5 (5.4) | 93.7 (4.3) | 49.8 (3.3) |

Average (Standard Deviation)

Figure 5:
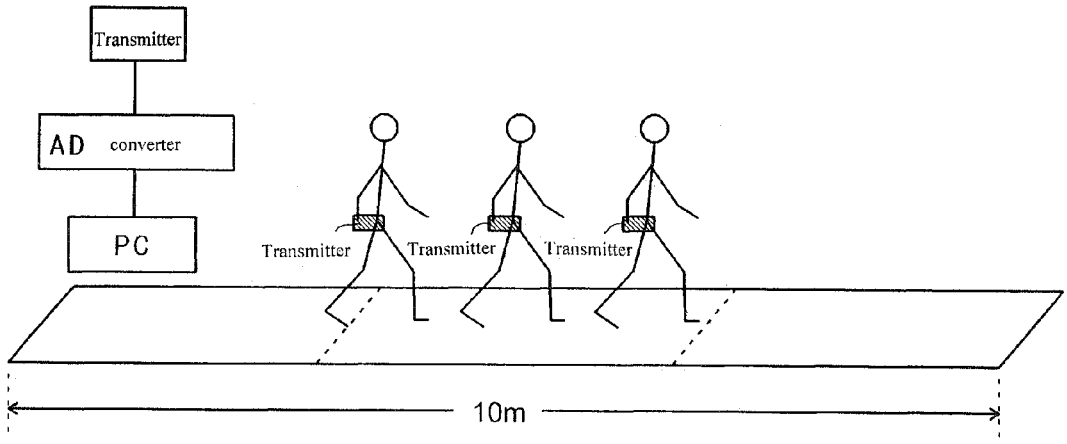
FIG. 5 is a schematic diagram illustrating a walking test for the article of clothing with effects of back pain exercise according to the present invention.
Figure 6:
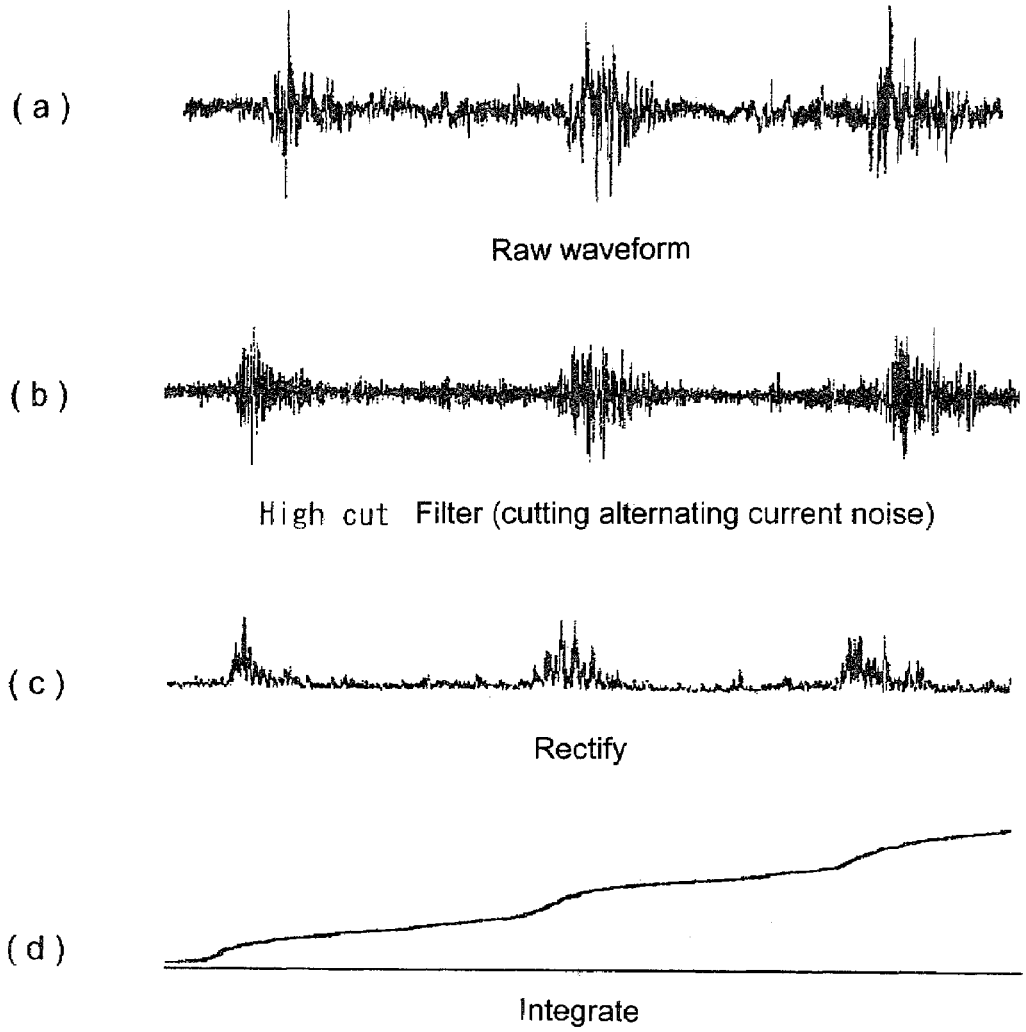
FIGS. 6A to 6D are waveforms obtained by a waveform processing procedure for determining muscle activities of gluteus medius muscles in the walking test.

Waveforms obtained by surface electromyogram were subjected to integral electromyogram analysis, and the amount of muscle discharge of the measured potential between the samples was quantified. Referring to FIG. 5, in the test, the subjects walked with and without wearing the articles of clothing according to the present invention. An analysis area was set at an intermediate position of the 10-m path. The subjects walked along the path five times for one set, and repeated seven sets, i.e., thirty five times in total. The amounts of muscle discharge obtained while the subjects walked thirty five times were determined as the muscle activities. Referring FIGS. 6A to 6D, in the measurement of the gluteus medius muscles, for example, the waveform shown in FIG. 6A was obtained as the raw waveform. Then, alternating current noise was cut by a 50-Hz high cut filter as shown in FIG. 6B, and the waveform was rectified as shown in FIG. 6C. Then, the waveform for one set including five times of walking was integrated as shown in FIG. 6D. The above-described measurement and waveform processing were performed for all of the eight portions corresponding to iliocostal muscles, rectus abdominis muscles, gluteus medius muscles, gluteus maximus muscles, vastus lateralis muscles, rectus femoris muscles, biceps femoris muscles, and gastrocnemius muscles.

TABLE 2

Changes in muscle activities obtained by article of clothing of the present invention.

| Part | Iliocostal Muscle | Rectus Abdominis Muscle | Gluteus Medius Muscle | Gluteus Maximus Muscle | Vastus Lateralis Muscle | Rectus Femoris Muscle | Biceps Femoris Muscle | Gastrocnemius Muscle |
|---|---|---|---|---|---|---|---|---|
| Tendency | ↘ Decrease | ↗ Increase | → Equal or Increase | ↘ Decrease | ↗ Increase | ↗ Increase | ↘ Decrease | ↘ Decrease |
| Importance Level | — | Very Important | — | — | Very Important | Very Important | — | — |

Electrodes for taking the electromyograms were attached to the skin surface of each of the fifteen subjects at the eight positions corresponding to iliocostal muscles, rectus abdominis muscles, gluteus medius muscles, gluteus maximus muscles, vastus lateralis muscles, rectus femoris muscles, biceps femoris muscles, and gastrocnemius muscles. Before attaching the electrodes, the skin was shaved at the positions where the electrodes are to be attached, grease was removed by ethanol, and the epidermis of the skin was removed with cream containing fine particles. In addition, a discharge ground was adhered to the chest of each subject. The electromyogram data was transmitted from a transmitter of a multi-telemeter system (WEB-5500 produced by Nihon Kohden Corporation) to a receiver, converted by an AD converter (MP-System produced by BIOPAC Systems, Inc.), and was processed using a biometric information analysis program (AcqKnowledge produced by BIOPAC Systems, Inc.). Thus, the muscle activities during waking were measured at a sampling frequency of 1000 Hz.

Three criterions were used for determining the effects of back pain exercise expected by the articles of clothing according to the present invention on the basis of Table 2. The number and rate of people who satisfied the criterions were checked.

The three criterions were as follows:

Criterion 1: A statistically meaningful improvement of muscle activity was obtained between data of cases where the article of clothing was and was not worn during walking in at least one of the important portions (muscles in the front of the body: rectus abdominis muscles, vastus lateralis muscles, and rectus femoris muscles).

Criterion 2: A statistically meaningful reduction of muscle activity was obtained between data of cases where the article of clothing was and was not worn during walking in two or more of muscles in the back of the body (iliocostal muscles, gluteus maximus muscles, vastus lateralis muscles, and rectus femoris muscles)

Criterion 3: A statistically meaningful change in muscle activity was obtained between data of cases where the article of clothing was and was not worn during walking at five or more of the eight positions.

In the above-described test, five out of fifteen subjects showed an improvement in muscle activity in one or more of the muscles in the front of the body, that is, rectus abdominis muscles, vastus lateralis muscles, and rectus femoris muscles mentioned in criterion 1. In addition, six out of fifteen subjects showed a reduction in muscle activity in two or more of the muscles in the back of the body, that is, iliocostal muscles, gluteus maximus muscles, vastus lateralis muscles, and rectus femoris muscles mentioned in criterion 2. In addition, seven out of fifteen subjects showed a change in muscle activity at five or more of the eight positions.

As a result, it was reported by the national university that the article of clothing according to the present invention is capable of controlling the posture of the wearer and changing the muscle activities during walking. Eleven out of fifteen subjects of the verification test satisfied one or more of criterions 1 to 3. Accordingly, the article of clothing according to the present invention provided the effects of curing or relieving back pain by changing the muscle activities in 73.3% of the subjects.

TABLE 3

| | Number and rate of subjects that satisfied the criterions | | | | | | | |
|---|---|---|---|---|---|---|---|---|
| | Criterion 1 | | Criterion 2 | | Criterion 3 | | One or more of Criterions 1 to 3 | |
| Number of subjects that satisfied criterion | 5 | 33.3% | 6 | 40% | 6 | 40% | 11 | 73.3% |
| Number of subjects that did not satisfy criterion | 10 | 66.6% | 9 | 60% | 9 | 60% | 4 | 26.6% |

Different from the article of clothing 1 according to the above-described embodiment, the present invention may also be applied to an outerwear, such as outerwear pants and tights. In such a case, the article of clothing 1 shown in FIGS. 1 to 4 are sewn to the pants or tights as lining at a predetermined position corresponding to the lumbar portion. For men's wear, a fly can be provided in the front body as necessary for convenience. In such a case, the fly is formed of a closable zipper or the like to maintain the tensile strength of the knitting fabric.

What is claimed is:

1. An article of clothing for the lower half of the human body, the article of clothing having a function of body shape correction and including a main body formed of main-body knitting fabric, the main-body knitting fabric providing a high degree of tightness and being made of power net, the article of clothing comprising:

front support pieces formed of interlining having no elasticity in a longitudinal direction thereof, the front support pieces being sewn to a front body of the article of clothing at positions inside the ilia on the left and right of the abdominal pelvis of the wearer;

back support pieces formed of interlining having no elasticity in a longitudinal direction thereof, the back support pieces being sewn to a back body of the article of clothing at left and right positions that are closer to the back support piece than the gluteus medius muscles of a wearer;

waist pieces extending rearward from side portions between the front support pieces and the respective back support pieces to regions around the gluteus medius muscles, the waist pieces having a three-layer structure including the main-body knitting fabric and net-like knitting fabric folded at a bottom edge to form a two-layer structure and placed on the main-body knitting fabric, the net-like knitting fabric providing a high degree of tightness;

a navel cover piece provided in the front body and having a three-layer structure in which the main-body knitting fabric is folded so as to sandwich the net-like knitting fabric; and an abdomen piece disposed below the navel cover piece and having a two layer structure including the main-body knitting fabric facing outside and the net-like knitting fabric facing inside, wherein the waist pieces having the three-layer structure and the navel cover piece having the three-layer structure are configured to increase an abdominal pressure for preventing or relieving back pain, wherein, in the waist pieces having the three-layer structure, the main-body knitting fabric and the net-like knitting fabric folded to form the two-layer structure are sewn together at a top edge thereof, and the folded bottom edge of the net-like knitting fabric forming the two-layer structure is not sewn to the main-body knitting fabric and is free from the main-body knitting fabric in areas other than a central area of the back body, thereby providing a function of pulling both sides of the pelvis rearward to facilitate a forward movement of the sacrum and reduce lordosis of the lumbar spine, and wherein the article of clothing has a pant-like shape with left and right leg parts that can be tightly fitted around the thighs.

2. The article of clothing according to claim 1, further comprising:

a piece disposed below the waist in the back body and formed only of the main-body knitting fabric; and a waist piece disposed between the back support pieces in a central area of the back body and formed of the net-like knitting fabric folded to form a two-layer structure, thereby providing a tight-fit feeling, wherein the waist pieces between the front support pieces disposed at positions near the pelvis in the front body and the respective back support pieces are tightly restrained such that the knitting fabric of the waist pieces is pulled toward the back support pieces.

3. The article of clothing according to claim 1 or 2, wherein back thigh pieces of the article of clothing having the pant-like shape have a two-layer structure including the main-body knitting fabric and the net-like knitting fabric, so that tensile load is applied thereto when the thighs are lifted during walking.

4. The article of clothing according to claim 2, wherein the main-body knitting fabric and the net-like knitting fabric have a tensile strength of 490 mN or more when stretched by 30%.

* * * * *